US006502904B1

(12) United States Patent
Hansen

(10) Patent No.: US 6,502,904 B1
(45) Date of Patent: Jan. 7, 2003

(54) ARM SUPPORT FOR A CHAIR

(75) Inventor: Eckhard Hansen, St. Margrethen (CH)

(73) Assignee: SDM Hansen AG, Margrethen (CH)

( * ) Notice: Subject to any disclaimer, the term of this patent is extended or adjusted under 35 U.S.C. 154(b) by 0 days.

(21) Appl. No.: 09/536,496

(22) Filed: Mar. 27, 2000

(30) Foreign Application Priority Data

Apr. 12, 1999 (AT) ..... 636/99

(51) Int. Cl.[7] ..... A47C 7/54
(52) U.S. Cl. ..... 297/411.35; 297/411.38
(58) Field of Search ..... 297/411.35, 411.38, 297/411.36, 411.37

(56) References Cited

U.S. PATENT DOCUMENTS 4,961,610 A 10/1990 Reeder et al.
5,382,079 A 1/1995 Wilson et al.
5,586,811 A 12/1996 Tornero
5,655,814 A * 8/1997 Gibbs ..... 297/411.38
5,876,097 A 3/1999 Cao
5,927,811 A * 7/1999 Tseng ..... 297/411.31
6,062,647 A * 5/2000 Mei ..... 297/411.36 X
6,076,892 A * 6/2000 Van Hekken et al. ... 297/411.35

OTHER PUBLICATIONS

EPO Search.

* cited by examiner

*Primary Examiner*—Anthony D. Barfield
(74) *Attorney, Agent, or Firm*—Robert F. I. Conte; Lee, Mann, Smith, McWilliams, Sweeney, Ohlson

(57) ABSTRACT

Arm support for a chair comprising an upright stand (2) fixed to the chair and having an upper end which supports the arm support (1), said arm support (1) being movable on a substantially horizontal plane and possibly turnable around a vertical axis. The arm support (1) comprises a first guide plate (9) provided with guide openings (12) arranged on the rims and running along the longitudinal direction of the arm support, in which sliders (15) coupling geometrically the guide openings (12) are present, said sliders (15) being tightly connected to a second guide plate (14), the length of the second guide plate (14) along the shift direction being smaller than the length of the first guide plate and the second guide plate (14).

9 Claims, 4 Drawing Sheets

ARM SUPPORT FOR A CHAIR

FIELD AND BACKGROUND OF THE INVENTION

The present invention relates to an arm support for a chair provided with an upright stand, which is fixed to the chair and on whose upper end the arm support is located in a movable position on a substantially horizontal plane and it may possibly turn around a vertical axis.

Such arm supports are known in several different embodiments. As mere examples and without any claim to completeness we might quote here the ideas resulting from the following publications: DE 44 15 264 A1; DE 43 17 610 A1; DE 295 11 267 U1; DE 295 02 429 U1; DE 295 19 794 U1; DE 88 14 053 U1; DE 87 16 965 U1; U.S. Pat. Nos. 5,407,249; 5,369,805 5,324,096.

SUMMARY OF THE INVENTION

The present invention results from said state of the art and aims not only at simplifying the idea underlying the carrying out of the regulation of the arm support which is described in said works, but also at carrying out said support with height as reduced as possible. The solution to this problem is characterized by a first guide plate located on the lower side of the arm support, provided with guide openings running longitudinally with respect to the arm support and placed on the rim, in which there ate sliders coupling geometrically the guide openings, said sliders being tightly connected to a second guide plate, the length of the second guide plate along the shift direction being smaller than the length of the first guide plate and the second guide plate being connected to the upright stand.

BRIEF DESCRIPTION OF THE DRAWINGS

The invention will be illustrated by means of a detailed description of an example of embodiment, with reference to the enclosed drawings, though without limiting the invention to said example. The drawings show.

DESCRIPTION OF THE PREFERRED EMBODIMENT

Figure 1:
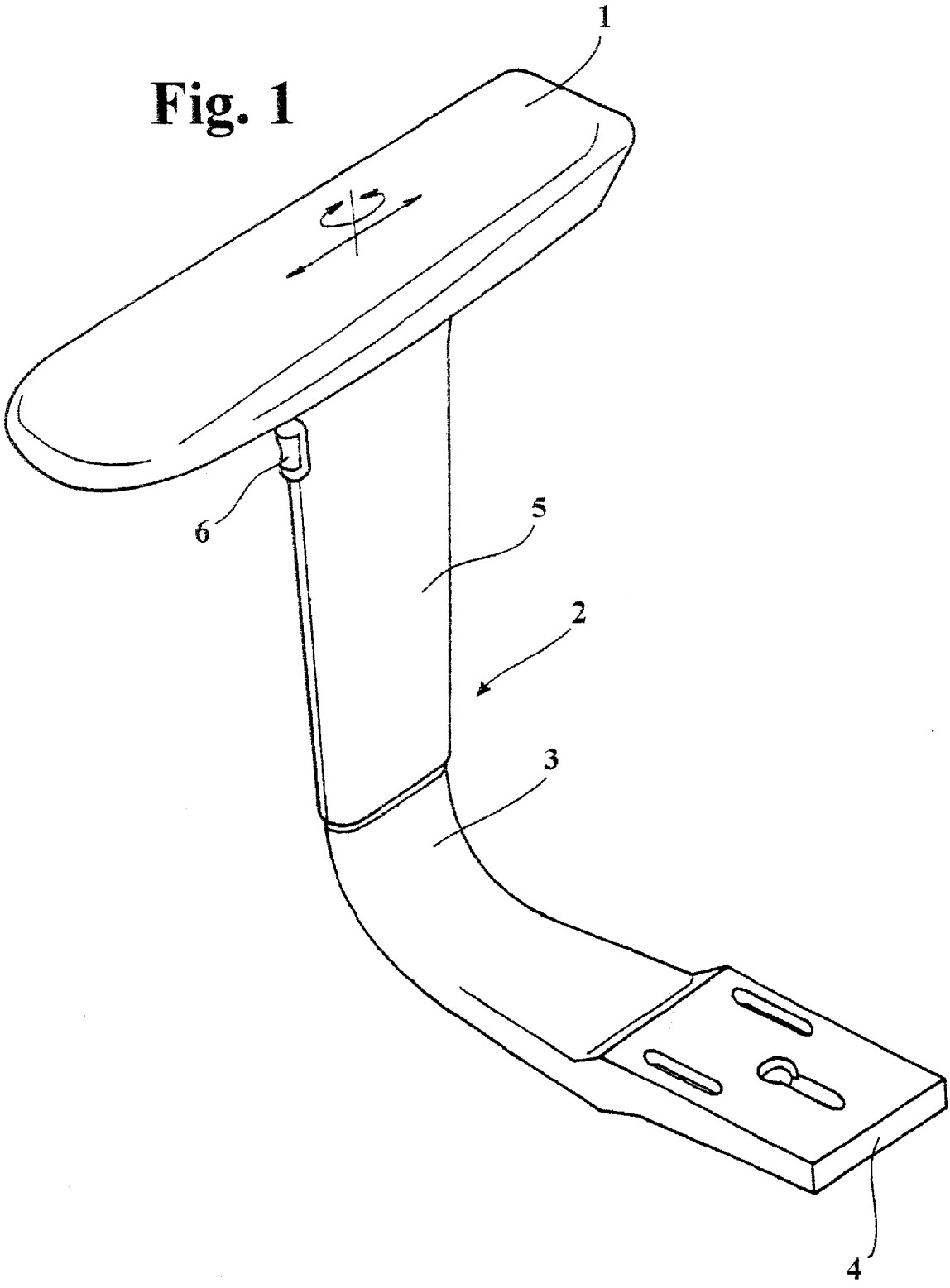
FIG. 1 the arm support with the stand for a chair in an oblique view.
Figure 3:
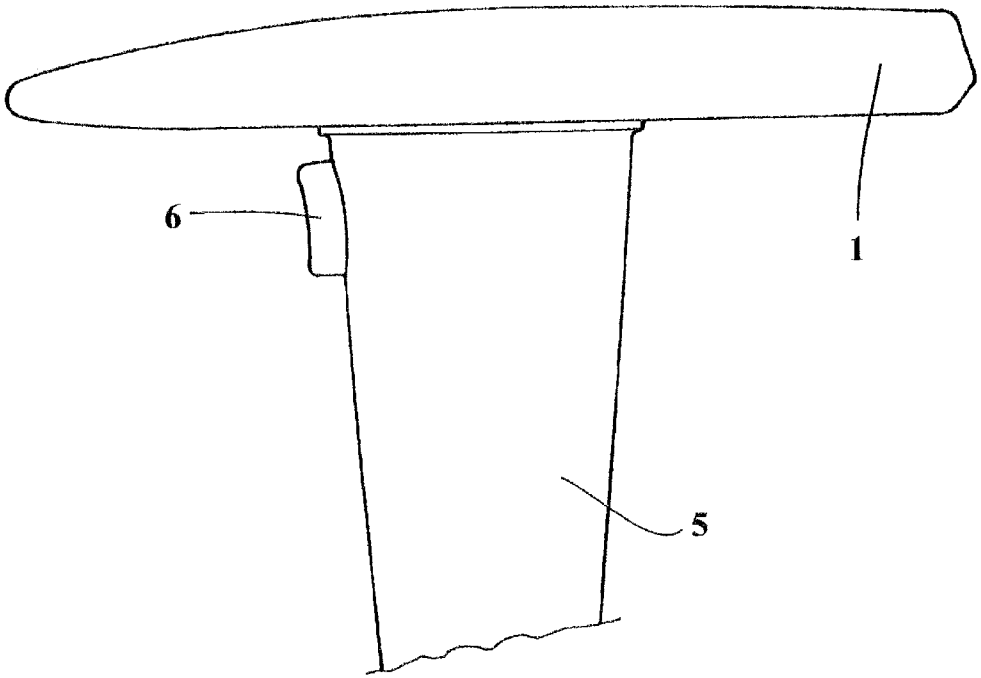
FIG. 3 in a lateral view.
Figure 2:
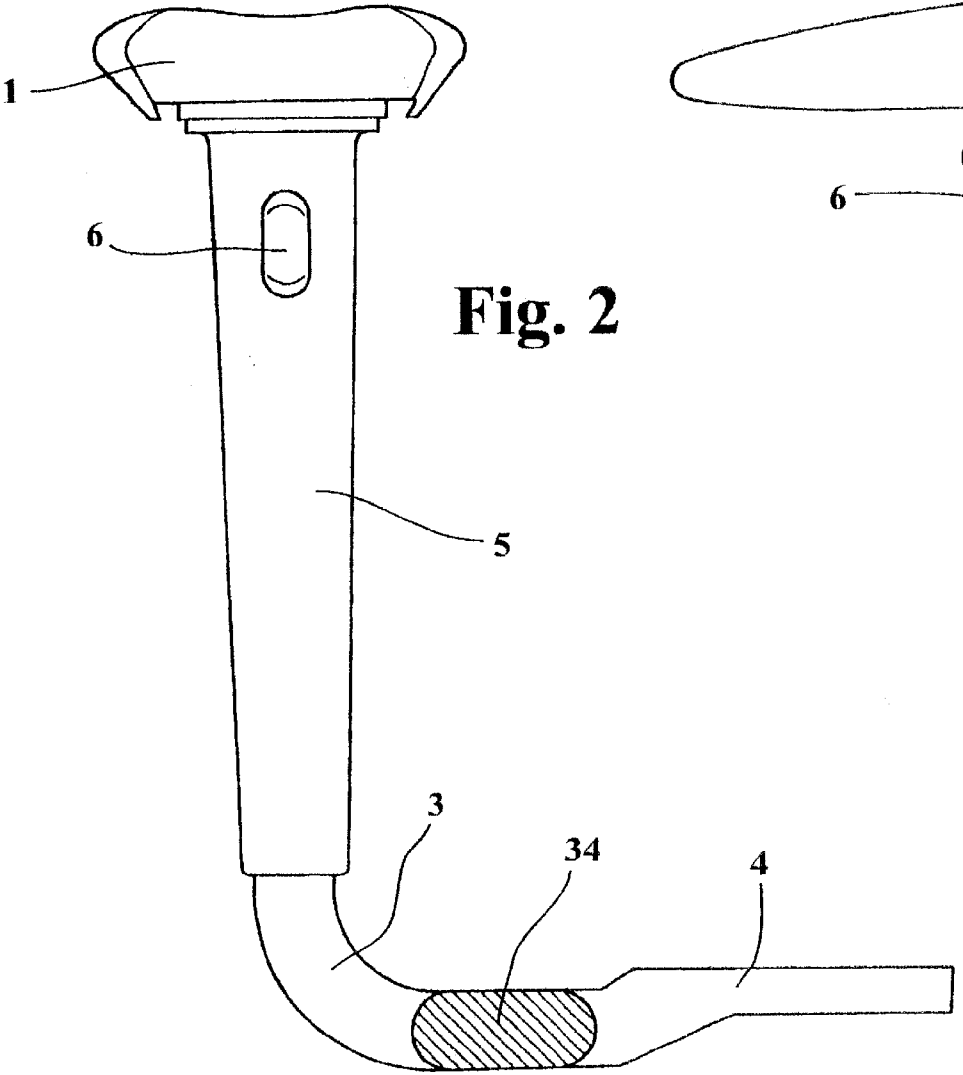
FIG. 2 in a front view.

The arm support 1 for a chair, the latter not being shown, leans onto an upright stand 2. Said stand 2 has a telescopic conformation and shows a fixed bar-shaped draw piece 3 with a lower fastening flange 4, by means of which the arm support or its stand 2 can be fastened to a chair frame. Moreover, said stand 2 shows a cone-shaped tubular element 5, the cone-shaped stroke of said tubular element 5 widening upwards.

An operating button 6 is provide in said tubular element 5 under the arm support 1, its function being explained with more details later on.

Figure 4:
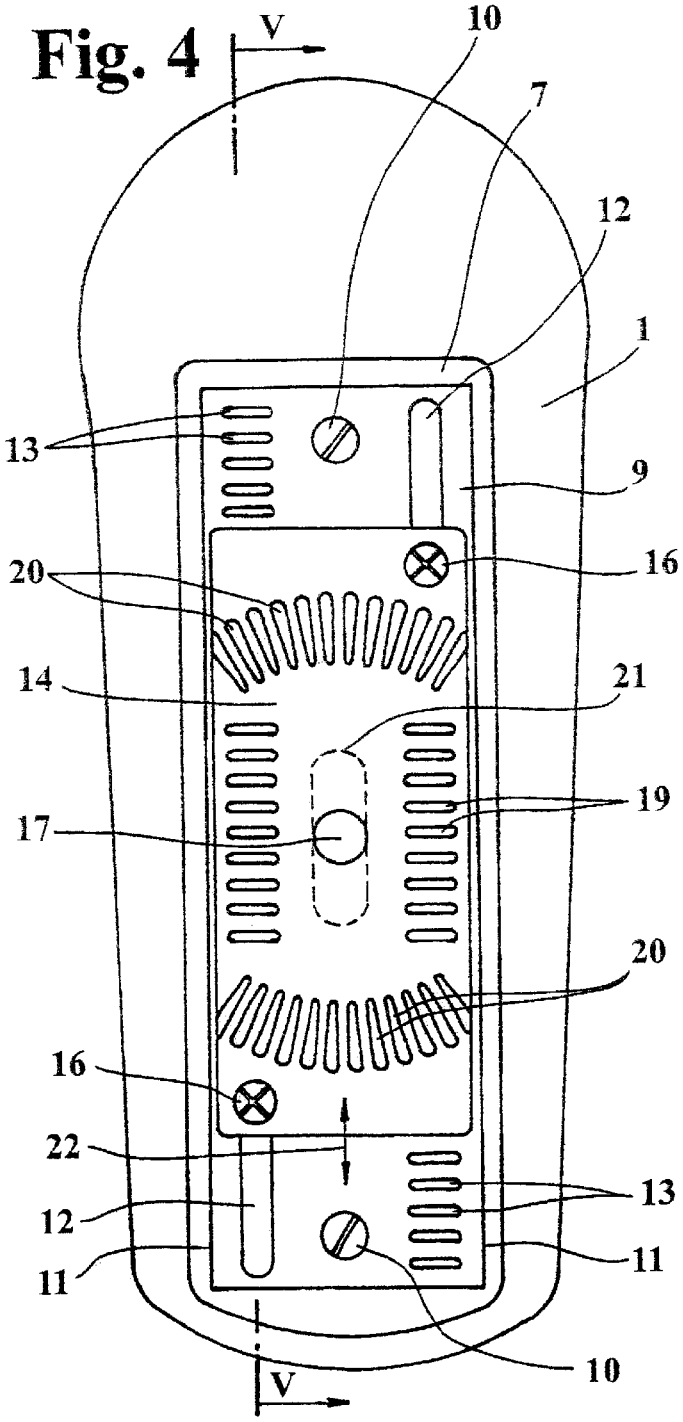
FIG. 4 a view from below of the arm support without the stand.
Figure 5:
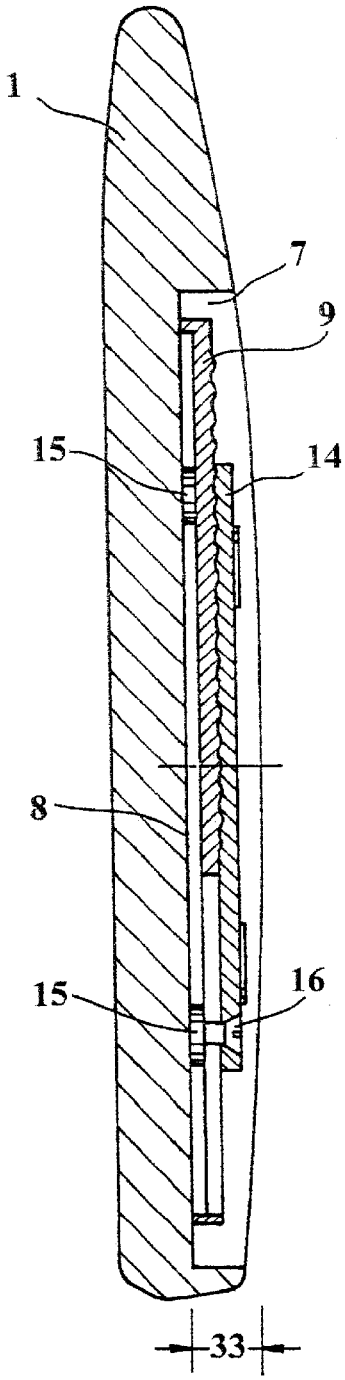
FIG. 5 a longitudinal section of the arm support following line V—V of FIG. 4.
Figure 9:
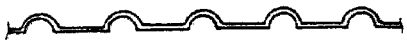

FIG. 4 shows a view from below of the arm support 1 without the stand 2. A rectangular notch is obtained in the lower side of said arm support 1, said notch showing a substantially flat bottom 8 to which a first guide plate 9 is fastened, in; this case by means of both screws 10. The length and width of this first guide plate 9 are substantially the same as those referring to the notch 7, so that this first guide plate 9 can be contained completely inside said notch 7. Longitudinal guide openings 12 are provided near the longitudinal sides 11 of this first guide plate 9, said guide openings 12 covering only approximately half the length of the first guide plate and being also shifted longitudinally one with respect to the other, as shown in FIG. 4. Stopping elements are arranged in a row on the longitudinal side of said guide openings 12 and are connected to the latter, said stopping elements consisting of rib-shaped indentations 13 with their longitudinal sides one beside the other. The height of said rib-shaped indentations 13 is smaller than the thickness of the guide plate on which they lie, as schematically shown in the longitudinal section of FIG. 9. In the example of embodiment shown said rib-shaped indentations 13 of the first guide plate project upwards, that is to say, out of the drawing plane of FIG. 4.

On said first guide plate a second guide plate 14 is supported in a movable position by means of sliders 15, said sliders 15 coupling geometrically the rear side of the guide openings 12. Said sliders 15 are fastened by means of pins 16, which themselves are fixed to said second guide plate 14. Screws and nuts can be used as guide pins 16 and sliders 15. A central hole 17, located on said second guide plate 14, houses a kingpin 18, which is connected to the stand 2. As for the indentations 13 of the first guide plate 9, arranged in a row, the second guide plate 14 is provided with corresponding row sections of analogous indentations 19, which are directed against the indentations 13 of the first guide plate. In addition to these straight rows of indentations 19, other indentations 20, arranged in a row having the shape of the arc of a circle, are placed around the central hole 17, said rib-shaped indentations 20, here arranged along the line of an arc, projecting upwards with respect to the drawing plane (FIG. 4), that is to say, projecting upwards with respect to the surface of the second guide plate 14 which is visible here. Springs clamping both guide plates 9 and 14 one against the other can also be provided in connection to the pin 18, said pin 18 passing through the central hole 17 in the second guide plate 14 and reaching a slot-shaped recess running parallel to the guide openings 12 of the first guide plate 9, said slot-shaped recess being indicated in FIG. 4 by means of a dashed line 21. The axial length of said slot-shaped recess, indicated by the dashed line 21, corresponds to the horizontal shift of the arm support 1. FIG. 4 shows that both guide plates 9 and 14 can be shifted one with respect to the other along arrow 22, each position along this shift being maintained by means of said indentations 13 and 19 shaped as stopping elements.

Figure 6:
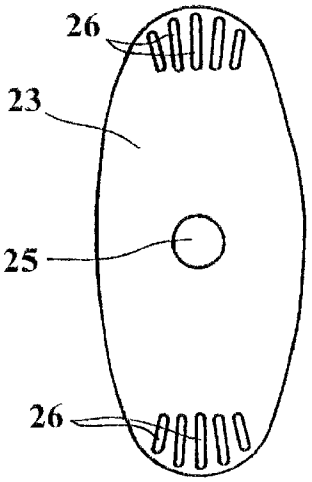
FIG. 6 a top view of the support plate of the stand, directly connected to the arm support.
Figure 7:
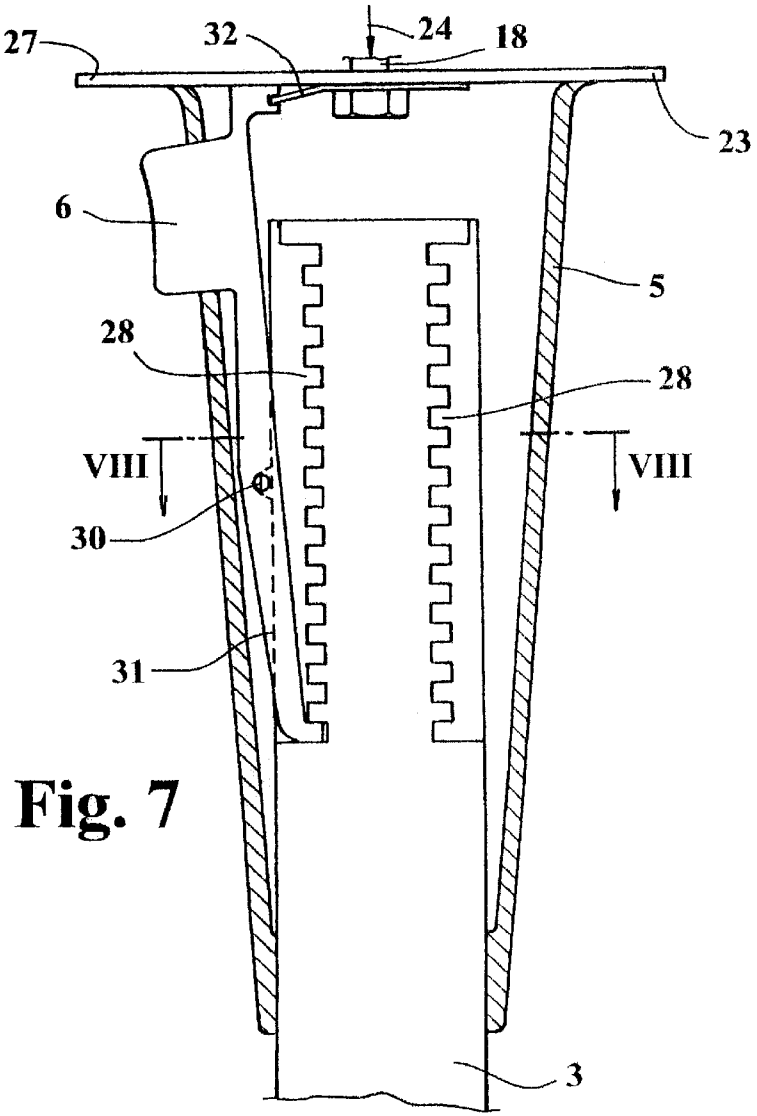
FIG. 7 a vertical section of the stand.

The upper part of the tubular element 5 of the stand 2 is closed by means of a support plate 23, shown in front view (following arrow 24 in FIG. 7) in FIG. 6.

Said support plate 23 is provided with rib-shaped indentations 26, arranged on arc lines around the central hole 25, said indentations 26 projecting upwards with respect to the upper side 27 of said support plate 23.

Their position and arrangement are analogous to those of the indentations 20 on the second guide plate 14.

Figure 8:
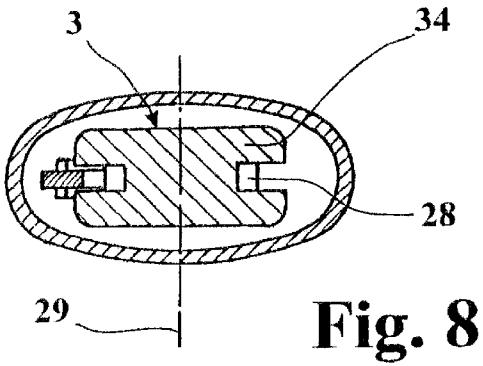
FIG. 8 a cross section of the stand following line VIII—VIII of FIG. 7 and FIG. 9 a schematic longitudinal section of indentations placed in a row, whose longitudinal sides are located one beside the other, said indentations being shaped like ribs and working as stopping elements.

The draw piece 3, having a single-axis symmetrical cross section 34 (FIG. 8), shows two toothed rims 28, which are arranged on opposite sides of said draw piece 3. Said toothed rims constitute the bottom side of grooves running vertically, said grooves or the toothed rims contained herein are symmetrical to the symmetry axis 29 of the cross section 34 of the draw piece 3. The tubular element 5 is provided with a two-arm regulation lever 31, running vertically around an axis 30, fixed with respect to said tubular element 5, the lower end of said regulation lever 31 being coupled geometrically to one of the toothed rims 28 and the aforesaid operating button 6 being fixed on its upper arm. The upper end of said regulation lever 31 is supported by means of a spring 32, which maintains said regulation lever 31 in the position shown in FIG. 7.

The details referring to the connection between the tubular element 5 and the support plate 23 or between the stand 2 and the arm support 1 are not illustrated here.

The present document shows that the arm support 1 can be shifted with respect to the second guide plate 14 in longitudinal direction (arrow 22), the single positions of said shift being maintained by means of the indentations 13 and 19 shaped as stopping elements. Moreover, the arm support 1 can be turned around the kingpin 18 on a horizontal plane, here again the single positions of said shift being maintained by means of the indentations 20 and 26 shaped as stopping elements. In order to limit the rotation angle, the depth 33 of the notch 7 can be sized in such a way that at least the support plate 23 of the tubular element 5 can be placed within said notch 7, so that during the rotation said support plate 23 abuts with its rims onto the sides of said notch 7. However, it is also possible to provide, between the support plate 23 and the second guide plate 14, bounding elements, for instance a pin arranged in an arc-shaped recess, the length of the arc of said arc-shaped recess defining the amplitude of the rotation angle.

In order to regulate the height of the arm support 1 the operating button 6 should be pressed so as to raise the tubular element 5 as far as the desired height is reached. The operating button 6 is then released and the spring 32 turns the regulation lever 31 back to its rest position. Thanks to the shape of the cross section of the draw piece 3 and to the arrangement of the toothed rims 28, the arm support described here can be used both for the right-hand and for the left-hand side of a chair. The tubular element 5 should only be taken out of the draw piece 3, then rotated of 180 degrees and eventually slipped back onto the draw piece 3. Not only does this make storage easier, but it also reduces production costs, since the same arm support can be used for the right-hand and left-hand side of an armchair.

What is claimed is:

1. Arm support for a chair comprising:

an upright stand (2), which is fixable to the chair and on whose upper end the arm support (1) is supported in a movable position on a substantially horizontal plane and the arm support may possibly turn around a vertical axis, a first guide plate (9) placed on a lower side of the arm support (1), provided with guide openings (12) arranged on rims of the first guide plate (9) and running along a longitudinal direction of the arm support (1), a second guide plate (14) connected to the stand (2);

sliders (15) coupling geometrically the guide openings (12) and tightly connected to the second guide plate (14), the length of the second guide plate (14) along the shift direction being smaller than the length of the first guide plate (9);

wherein the guide openings (12) provided in the first guide plate (9) cover only approximately half the length of said guide plate (9) and said guide openings (12) are offset one with respect to the other in the longitudinal direction of the guide plate (9).

2. Arm support as claimed in claim 1, wherein stopping elements are provided between the first and the second guide plate (9, 14), and said stopping elements consists of rib-shaped indentations (13), which are arranged in rows and whose longitudinal sides are located one beside the other.

3. Ann support as claimed in claim 2, wherein the height of the ribshaped indentations (13) is smaller than the thickness of the guide plates (9, 14) where they are located.

4. Arm support as claimed in claim 1, wherein a straight row of stopping elements is provided next to and at an end of the guide openings (12) of the first guide plate.

5. Arm support for a chair comprising:

an upright stand (2), which is fixable to the chair and on whose upper end the arm support (1) is supported in a movable position on a substantially horizontal plane and the arm support may possibly turn around a vertical axis, a first guide plate (9) placed on a lower side of the arm support (1), provided with guide openings (12) arranged on rims of the first guide plate (9) and running along a longitudinal direction of the arm support (1), a second guide plate (14) connected to the stand (2);

sliders (15) coupling geometrically the guide openings (12) and tightly connected to the second guide plate (14), the length of the second guide plate (14) along the shift direction being smaller than the length of the first guide plate (9);

wherein the sliders (15) of the second guide plate (14) are provided on two corners of said second guide plate (14), one diagonal to the other, and a straight row of indentations (19) shaped as stopping elements runs parallel to the longitudinal rims of this second guide plate (14).

6. Arm support as claimed in claim 5, wherein the second guide plate (14) shows a central hole (17) housing a kingpin (18), which is connected in its turn with the stand (2), and at least one row of indentations (20) of the second guide plate (14) shaped as stopping elements and running around said axis as an arc, is provided around the central hole (17) working as the center.

7. Arm support as claimed in claim 6, wherein the stand (2) shows an upper support plate (23) provided with said kingpin (18), and at least one row of indentations (26) of the upper support plate (23) shaped as stopping elements and running around said axis as an arc, is provided around the axis of the kingpin (18), working as the center, said indentations (26) of the upper support plate (23) cooperating and being geometrically coupled with the indentations (20) of the second guide plate (14).

8. Arm support for a chair comprising:

an upright stand (2), which is fixable to the chair and on whose upper end the arm support (1) is supported in a movable position on a substantially horizontal plane and the arm support may possibly turn around a vertical axis, a first guide plate (9) placed on a lower side of the arm support (1), provided with guide openings (12) arranged on rims of the first guide plate (9) and running along a longitudinal direction of the arm support (1), a second guide plate (14) connected to the stand (2);

sliders (15) coupling geometrically the guide openings (12) and tightly connected to the second guide plate (14), the length of the second guide plate (14) along the shift direction being smaller than the length of the first guide plate (9), wherein said upright stand (2) has a telescopic conformation and it is provided with a fixed barshaped draw piece (3), showing at least a longitudinal toothed rim (28), and with a tubular element (5) housing said draw piece (3), and the tubular element (5) is provided with at least a two arm springloaded regulation lever (31), running in longitudinal direction and connectable to the toothed rim (28), an upper end of said regulation lever (31) projecting through an opening in the tubular element (5), thus forming an operating button (6), wherein the draw piece (3) shows a symmetrical cross section (34) with at least one axis, and the toothed rim (28) is provided in pairs on the diametrically opposite longitudinal sides of the draw piece (3), the toothed rim (28) forming a bottom portion of vertical longitudinal grooves.

9. Arm support for a chair comprising an upright stand (2), which is fixable to the chair and on whose upper end the arm support (1) is supported in a movable position on a substantially horizontal plane and thearm support may possibly turn around a vertical axis, a first guide plate (9) placed on a lower side of the arm support (1), provided with guide openings (12) arranged on rims of the first guide plate (9) and running along a longitudinal direction of the arm support (1), a second guide plate (14) connected to the stand (2);

sliders (15) coupling geometrically the guide openings (12) and tightly connected to the second guide plate (14), the length of the second guide plate (14) along the shift direction being smaller than the length of the first guide plate (9). Wherein the first and the second guide plates (9, 14) are placed in a notch (7) located on the lower side of the arm support (1), the depth (33) of said notch (7) being greater than the sum of the thickness of both guide plates (9, 14), and an upper support plate (23) closing an upper side of a tubular element (5) of said upright stand (2) is placed within said notch (7).

* * * * *